US007588244B2

(12) United States Patent
Kawamoto et al.

(10) Patent No.: US 7,588,244 B2
(45) Date of Patent: Sep. 15, 2009

(54) SHEET FEEDER WITH OPTICAL SENSOR

(75) Inventors: Masaru Kawamoto, Ibaraki (JP); Shingo Takai, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 122 days.

(21) Appl. No.: 11/603,141

(22) Filed: Nov. 22, 2006

(65) Prior Publication Data

US 2007/0121025 A1 May 31, 2007

(30) Foreign Application Priority Data

Nov. 25, 2005 (JP) ..... P2005-340139

(51) Int. Cl.
*B65H 7/02* (2006.01)

(52) U.S. Cl. ..... 271/31; 271/98; 271/152

(58) Field of Classification Search ..... 271/90, 271/94, 97, 98, 104, 30.1, 31, 152, 154, 155, 271/167, 169, 153; 250/229, 231.1, 231.11, 250/237 R See application file for complete search history.

(56) References Cited

U.S. PATENT DOCUMENTS

| | | | | |
|---|---|---|---|---|
| 4,469,320 | A * | 9/1984 | Wenthe, Jr. | 271/98 |
| 5,090,676 | A * | 2/1992 | Matsuno et al. | 271/12 |
| 5,645,274 | A * | 7/1997 | Ubayashi et al. | 271/94 |
| 5,707,056 | A * | 1/1998 | Rauen et al. | 271/96 |
| 7,267,337 | B2 * | 9/2007 | Moore et al. | 271/148 |
| 7,364,150 | B2 * | 4/2008 | Nakane | 271/97 |
| 7,374,163 | B2 * | 5/2008 | Cook et al. | 271/145 |
| 7,458,570 | B2 * | 12/2008 | Ueda et al. | 271/97 |
| 2001/0017441 | A1 * | 8/2001 | Yamaguchi et al. | 271/94 |
| 2005/0206068 | A1 * | 9/2005 | Sasaki et al. | 271/98 |

FOREIGN PATENT DOCUMENTS

| | | |
|---|---|---|
| JP | 07-187422 | 7/1995 |
| JP | 10-095543 | 4/1998 |
| JP | 2000-188420 | 7/2000 |

* cited by examiner

*Primary Examiner*—Patrick H Mackey
*Assistant Examiner*—Jeremy Severson
(74) *Attorney, Agent, or Firm*—McGinn IP Law Group, PLLC

(57) ABSTRACT

According to an aspect of the invention, there is provided a sheet feeder including; an air blowing unit floating and separating an upper portion of sheet of paper laid on a tray; and a transfer belt adsorbing and transferring uppermost sheet of paper laid on the tray; an optical analog sensor sensing an upper face of the uppermost sheet of paper and comprising a sensing face including a light receiving surface; a shield plate movable with the sheet, the shield plate detecting a position of upper face of the sheet of paper so as to keep a position of the uppermost sheet at a constant position and comprising; an elastic shield member having a C-character shape, a surface of the elastic shield member where the elastic shield member is contact with the light receiving surface of the optical analog sensor being in the same plane of a surface of the elastic shield member where the elastic shield member is contact with the shield-plate.

19 Claims, 3 Drawing Sheets

Related Art

SHEET FEEDER WITH OPTICAL SENSOR

CROSS-REFERENCE TO RELATED APPLICATION

This application is based on and claims the benefit of priority from the prior Japanese Patent Application No. 2005-340139, filed on Nov. 25, 2005; the entire contents of which are incorporated herein by reference.

TECHNICAL FIELD

The present invention relates to a sheet feeder for a printer.

BACKGROUND

Description of Related Art

The related-art method for detecting an upper face position of the uppermost sheet involves using a shield plate contacted with the upper face of the uppermost sheet to turn on/off an optical digital sensor placed at a predetermined position, or monitoring a voltage change of an optical analog sensor to keep the upper face position of the uppermost sheet constant based on a detection voltage (e.g., refer to JP-A-7-187422 and JP-A-10-95543). Also, an elastic member is employed as the shield plate in an optical analog sensor (e.g., refer to patent JP-A-2000-188420).

In a sheet feeder for separating the top of sheets by blowing the air, and adsorbing and feeding the sheet on an adsorption transfer belt, it is requisite to keep the upper face position of the uppermost sheet constant at any time to achieve the stable sheet feed.

When the upper face position of the uppermost sheet is detected, a shield plate having a weight of a fixed load or more at the rear end part of the sheet id disposed in contact with the upper face of the sheet so as not to be affected by floating or flutter of the sheet owing to the air for separation, and the upper face position of the sheet keeps constant by moving up a tray based on the presence or absence of detection by an optical sensor placed at a predetermined position. The optical sensor generally employs a digital sensor for sensing the ON/OFF, but it is effective for detecting the upper face position more stably that an analog sensor is used to correct for a variation in the height due to influence of a curl of the sheet. In the optical analog sensor, a change of the light quantity due to a light of the light emitting side, which is shielded by a shield plate, is detected by voltage detected on a light receiving side. The change of the light quantity may not be correctly detected due to a diffraction of the light and may also depend on fluctuation of position of the shield plate.

SUMMARY

It is an object of the invention to provide a sheet feed mechanism that is stable and highly reliable by preventing floating or peeling of the elastic shield member.

According to an aspect of the invention, the shield plate detects an upper face position and has a shape like C-character. A surface (C) of the elastic shield member where the elastic member is contact with a light receiving surface of the analog sensor is in the same plane of the surface (D) of the elastic shield member where the elastic shield member is contact with the shield plate. The elastic shield member has a bonding direction to a moving direction of the shield plate.

DESCRIPTION OF THE EMBODIMENTS

Figure 3:
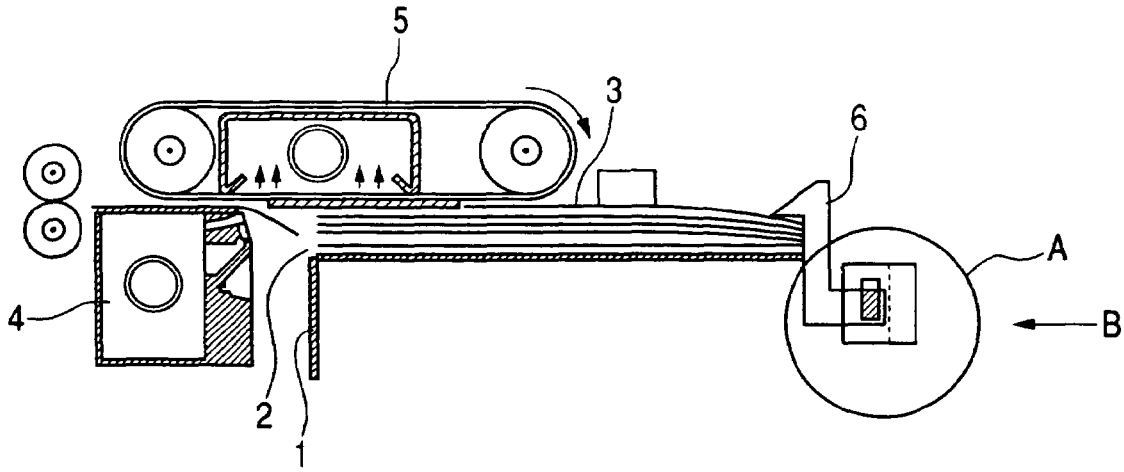
FIG. 3 is aside view showing one example of the related-art sheet feeder.
Figure 4:
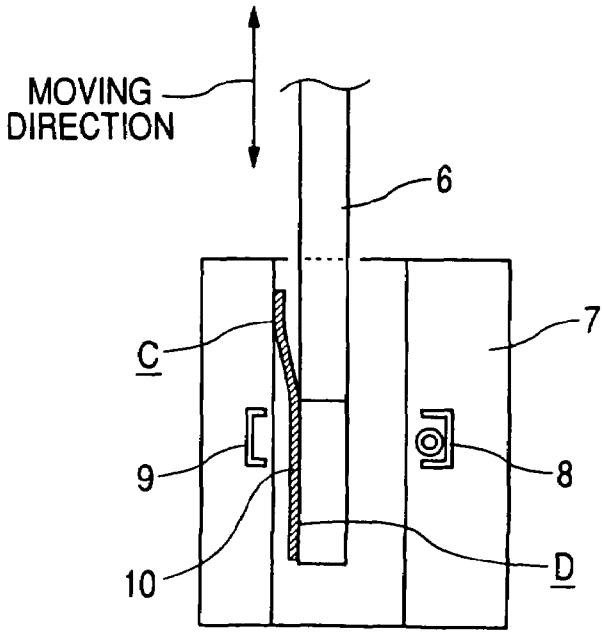
Related Art FIG. 4
FIG. 4 is an enlarged view of A portion of FIG. 3, as seen from the B direction.

The related-art sheet feeder is known in which an elastic shield member larger than the shield plate is disposed, and contacted with a sensing face of the analog sensor to detect the accurate upper face position of the sheet. Referring to FIGS. 3 and 4, this sheet feeder will be described below.

In FIGS. 3 and 4, an upper part of the sheets 2 laid on a tray 1 within a sheet hopper (not shown) is separated at the distal end by an air blow-off mechanism 4, and the uppermost sheet 3 only is adsorbed and fed by an adsorptive conveying mechanism 5. To feed the sheets 2 one by one accurately using the adsorptive conveying mechanism 5, a blowing air of the air blow-off mechanism 4 is applied to the number of sheets stably at any time in separating the sheet 2. The shield plate 6 capable of pressing the sheets with a certain weight or more is contacted with the upper face at the rear end of the uppermost sheet 3 not to be affected by flutter of the floating sheet due to blowing air, and the height of the shield plate 6 is detected by an optical analog sensor 7 to detect the upper face position of the sheet 2, whereby the upper face position of the sheet 2 is kept constant at any time using a mechanism (not shown) for moving up or down the tray 1. The optical analog sensor 7 has a light emitting part 8 and a light receiving part 9 which are oppositely disposed. Generally, the light emitting part 8 is composed of an LED lamp and the light receiving part 9 is composed of a CCD sensor. The light emitting part 8 emits the light to the light receiving part 9, and the light receiving part 9 converts the received light quantity into voltage. If the position of the shield plate 6 is changed, the received light quantity is also changed, so that the position can be detected. The shield plate 6 can be moved between the light emitting part 8 and the light receiving part 9 of the optical analog sensor. Therefore, the shield plate 6 is moved in position near the light receiving part 9 not to be affected by diffraction of the light from the light emitting part 8. Also, the shield plate 6 is moved in almost invariable position between the light emitting part 8 and the light receiving part 9 by a guide plate (not shown). However, since the shield plate 6 needs enough weight and rigidity to suppress flutter of the floating sheet 2 due to blowing air, the shield plate is required to be separated from the light receiving part 9 slightly. Therefore, there are some cases where the accurate detection is not made due to diffraction of the light from the light emitting part 8. Thus, as shown in FIG. 4, an elastic shield member 10 is added to the shield plate 6 and contacted with the light receiving part 9.

With the above constitution in FIG. 4, the elastic shield member 10 is attached in the same direction as the moving direction of the shield plate 6 and bonded on the opposite face to the contact face (C and D of FIG. 4). Accordingly, since a surface (C) of the elastic shield member where the elastic member is contact with a light receiving surface of the analog sensor is not in the same plane of the surface (D) of the elastic shield member where the elastic shield member is contact with the shield plate, A force is applied on the bonded portion such as a wedge when the elastic shield member is repeatedly contacted and moved, resulting in a problem that the bonded portion floats or peels.

Embodiments of the present invention will be described below with reference to FIGS. 1-6.

Figure 1:
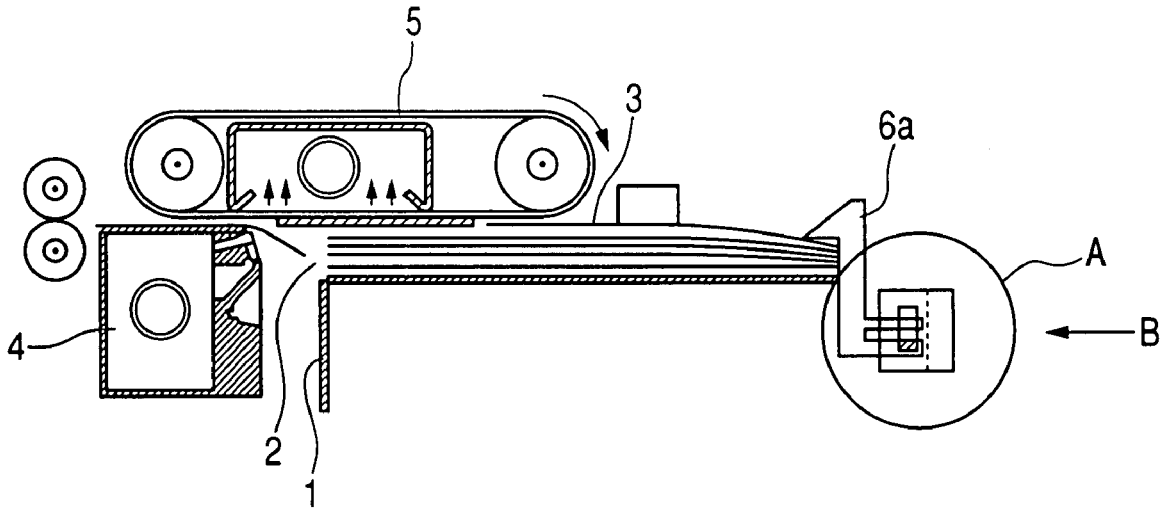
FIG. 1 is a side view showing a sheet feeder according to an embodiment of the present invention.
Figure 2:
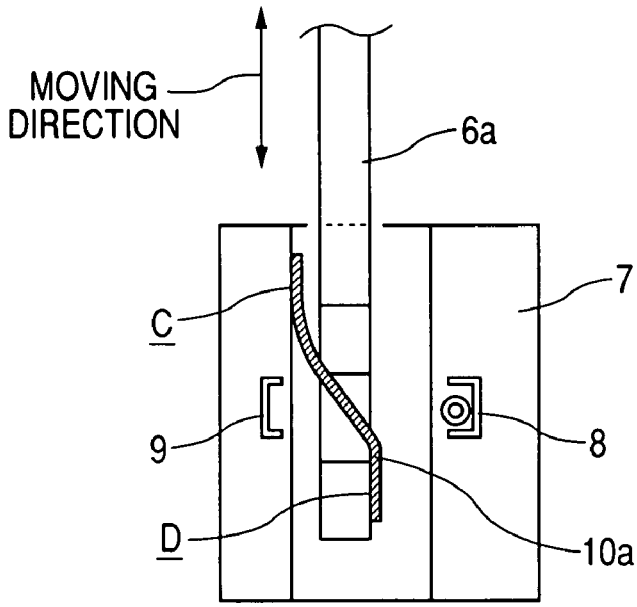
FIG. 2 is an enlarged view of A portion of FIG. 1, as seen from a B direction.

FIG. 1 is a side view showing a sheet feeder according to an embodiment of the invention. FIG. 2 is an enlarged view of A portion of FIG. 1, as seen from a B direction. In FIGS. 1 and 2, the reference numerals denote the same parts as in FIGS. 3 and 4, and the explanation of the same parts is omitted.

Figure 5:
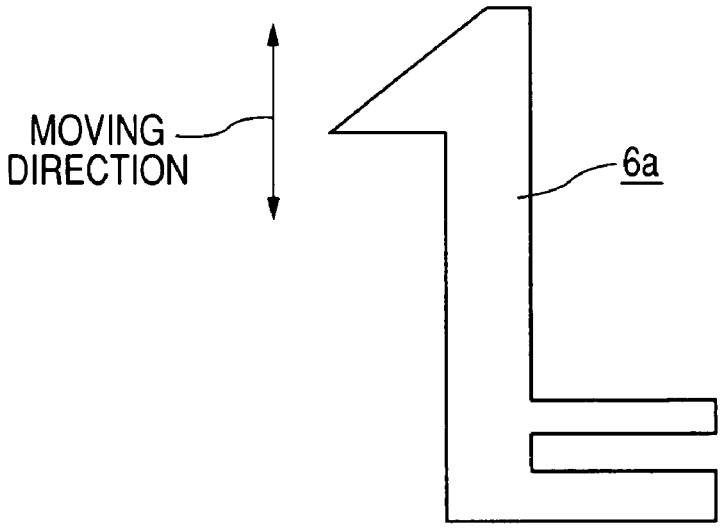
FIG. 5 is a view showing a shape of the shield plate according to the embodiment.

In FIGS. 1 and 2, reference numeral 6*a* denotes a shield plate, and reference numeral 10*a* denotes an elastic shield member. The shield plate 6*a* has the shape like a C-character at its lower part in parallel to a moving direction, as shown in FIG. 5. The elastic shield member 10*a* is bonded on the lower part of the shield plate 6*a* through an interval of the shape like a C-character of the shield plate 6*a*. A surface (C) of the elastic shield member 10*a* where the elastic shield member 10*a* is contact with a light receiving surface of the analog optical sensor 7 is in the same plane of the surface (D) of the elastic shield member 10*a* where the elastic shield member 10*a* is contact with the shield plate 6*a*. (Refer to C and D of FIG. 2).

Figure 6:
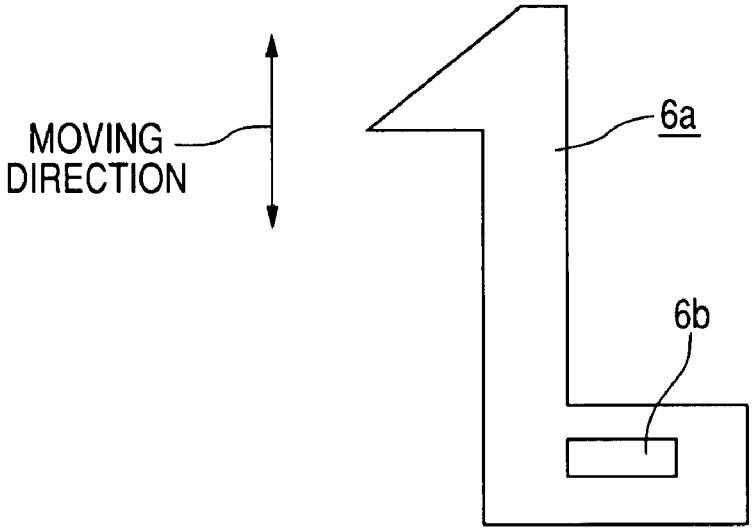
FIG. 6 is a view showing a shape of another shield plate according to the embodiment.

Though in this embodiment, the lower part of the shield plate 6*a* has the shape like C-character, the shield plate may be provided with a rectangular hole 6*b*, for example, in which the elastic shield member is passed into this rectangular hole 6*b*, as shown in FIG. 6, thereby achieving the same effect.

As described above, the elastic shield member 10*a* is bonded under the contact portion of the shield plate 6*a* having the shape like C-character on the same plane as in the contact direction. In other words, since the elastic shield member 10*a* is bonded on the lower part of the shield plate 6*a* through an interval of the shape like a C-character of the shield plate 6*a*, while a surface (C) of the elastic shield member 10*a* where the elastic shield member 10*a* is contact with a light receiving surface of the analog optical sensor 7 is in the same plane of the surface (D) of the elastic shield member 10*a* where the elastic shield member 10*a* is contact with the shield plate 6*a*. (Refer to C and D of FIG. 2), the elastic shield member 10*a* is guided and protected above the shield plate 6*a* having the shape like C-character. By thus above-described configuration, load due to a repetitive operation of the shield plate 6*a* does not suffer from a bonding portion.

According to the above embodiment, the stable and reliable sheet feed can be accomplished by providing a highly reliable mechanism that is inexpensive, simply attached, and protected against a deformation of the shield member.

What is claimed is:

1. A sheet feeder comprising:

an air blowing unit floating and separating an upper portion of a sheet of paper laid on a tray; a transfer belt adsorbing and transferring an uppermost sheet of paper laid on the tray;

an optical analog sensor sensing an upper face of the uppermost sheet of paper and comprising a sensing face including a light receiving surface; and a shield plate movable with the sheet, the shield plate detecting a position of an upper face of the sheet of paper so as to keep a position of the uppermost sheet at a constant position, an elastic shield member, within and partially parallel with the shield plate, which is in contact with a surface of the shield plate at a side facing toward a light emitting surface of the optical analog sensor, wherein the shield plate comprises:

a first surface facing toward the light emitting surface of the optical analog sensor; and a second surface facing toward the light receiving surface of the optical analog sensor, and wherein the elastic shield member comprises:

a first end at which the elastic shield member is in contact with the first surface of the shield plate; and a second end at which the elastic shield member is in slide-contact with the light receiving surface of the optical analog sensor.

2. The sheet feeder of claim 1, wherein the elastic shield member is bonded to the surface of the shield plate.

3. The sheet feeder of claim 1, wherein the shield plate includes an opening, and wherein the elastic shield member extends through the opening.

4. The sheet feeder of claim 1, wherein a portion of the shield plate has a C-shaped configuration, and wherein the elastic shield member extends through the C-shaped portion.

5. The sheet feeder of claim 1, wherein the light receiving surface and the surface of the shield plate substantially face the same direction.

6. The sheet feeder of claim 1, wherein the elastic shield member crosses through the first and second surfaces of the shield plate.

7. A sheet feeder comprising:

an air blowing unit floating and separating an upper portion of a sheet of paper located on a tray;

a transfer belt adsorbing and transferring an uppermost sheet of paper located on the tray;

an optical analog sensor sensing an upper face of the uppermost sheet of paper and comprising a sensing face including a light receiving surface;

a shield plate movable with the sheet, the shield plate detecting a position of an upper face of the sheet of paper so as to keep a position of the uppermost sheet at a constant position; and an elastic shield member which is in contact with a surface of the shield plate at a side facing toward a light emitting surface of the optical analog sensor, wherein the shield plate comprises:

a first surface facing toward the light emitting surface of the optical analog sensor; and a second surface facing toward the light receiving surface of the optical analog sensor, and wherein the elastic shield member comprises:

a first end at which the elastic shield member is in contact with the first surface of the shield plate; and a second end at which the elastic shield member is in slide-contact with the light receiving surface of the optical analog sensor.

8. The sheet feeder of claim 7, wherein the elastic shield member is bonded to the surface of the shield plate.

9. The sheet feeder of claim 7, wherein the shield plate includes an opening, wherein the elastic shield member extends through the opening.

10. The sheet feeder of claim 7, wherein a portion of the shield plate has a C-shaped configuration, and wherein the elastic shield member extends through the C-shaped portion.

11. The sheet feeder of claim 7, wherein the elastic shield member crosses through the first and second surfaces of the shield plate.

12. The sheet feeder of claim 11, wherein the light receiving surface and the first surface of the shield plate substantially face the same direction.

13. An elastic shield member with a sheet feeder, the sheet feeder comprising:

an optical analog sensor for sensing an upper face of an uppermost sheet of paper, wherein the optical analog sensor comprises a sensing face including a light receiving surface and a shield plate movable with the sheet, the shield plate detecting a position of an upper face of the sheet of paper so as to keep a position of the uppermost sheet at a constant position, and wherein the elastic shield member is in contact with a surface of the shield plate at a side facing toward a light emitting surface of the optical analog sensor, wherein the shield plate comprises:

a first surface facing toward the light emitting surface of the optical analog sensor; and a second surface facing toward the light receiving surface of the optical analog sensor, and wherein the elastic shield member comprises:

a first end at which the elastic shield member is in contact with the first surface of the shield plate; and a second end at which the elastic shield member is in slide-contact with the light receiving surface of the optical analog sensor.

14. The elastic shield member of claim 13, wherein the elastic shield member crosses through the first and second surfaces of the shield plate.

15. The elastic shield member of claim 13, wherein the sheet feeder includes an air blowing unit floating and separating an upper portion of a sheet of paper laid on a tray and a transfer belt adsorbing and transferring the uppermost sheet of paper laid on the tray.

16. The elastic shield member of claim 13, wherein the elastic shield member is configured to be bonded to the surface of the shield plate.

17. The elastic shield member of claim 13, wherein the shield plate includes an opening, and wherein the elastic shield member is configured to extend through the opening.

18. The elastic shield member of claim 13, wherein a portion of the shield plate has a C-shaped configuration, and wherein the elastic shield member is configured to extend through the C-shaped portion.

19. The elastic shield member of claim 13, wherein the light receiving surface and the surface of the shield plate substantially face the same direction.

* * * * *